United States Patent [19]

Winegard et al.

[11] 4,398,201

[45] Aug. 9, 1983

[54] ANTENNA DIRECTOR AND METHOD THEREFOR

[75] Inventors: John R. Winegard, Evergreen; Carey W. Shelledy, Wheat Ridge, both of Colo.

[73] Assignee: Winegard Company, Evergreen, Colo.

[21] Appl. No.: 244,030

[22] Filed: Mar. 16, 1981

[51] Int. Cl.[3] ..... H01Q 21/12

[52] U.S. Cl. ..... 343/815

[58] Field of Search ..... 343/815, 817, 818, 819; 5/451

[56] References Cited

U.S. PATENT DOCUMENTS

| | | | |
|---|---|---|---|
| 2,700,105 | 1/1955 | Winegard | 343/819 |
| 2,975,423 | 3/1961 | Wells | 343/818 |
| 3,599,217 | 8/1971 | Grant | 343/815 |

FOREIGN PATENT DOCUMENTS

| | | | |
|---|---|---|---|
| 1298158 | 6/1969 | Fed. Rep. of Germany | 343/819 |

OTHER PUBLICATIONS

Winegard Television Products, Catalog 179.

*Primary Examiner*—Eli Lieberman

*Attorney, Agent, or Firm*—Robert C. Dorr

[57] ABSTRACT

The improved director (10) of the present invention provides an apparatus and method for increasing the directive gain of an antenna (30), and more particular, for a director in the high VHF band region while reinforcing the low VHF band. The director (10) includes a first element (220) having two symmetrical half sections (222, 224) with inboard ends (240) of each of the half sections mounted to and insulated from the boom (20), a second element (210) having two symmetrical half sections (212, 214) with inboard ends (240) of each half section mounted to an insulated from the boom (20), a pair of opposing phasing lines (230) parallel to the longitudinal length of the boom (20) and separated from each other by a first predetermined distance (410) wherein each phasing line (230) is electrically interconnected with the inboard ends (240) of the first and second element half sections (212 and 222, 214 and 224) located on the same side as the boom (20). Each half section of the first element (220) is substantially one half-wavelength electrically long in the high VHF band and the second element (210) and substantially one half-wavelength electrically long in the high VHF band. The two elements (210 and 220) are substantially spaced at a quarter wavelength in the high VHF band. The capacitance existing between the phasing lines (230) provides sufficient tuning so that the resonating currents in the first half section (222) of the first element (220) and the second half section (224) of the first element (220) are substantially in phase and additive.

13 Claims, 13 Drawing Figures

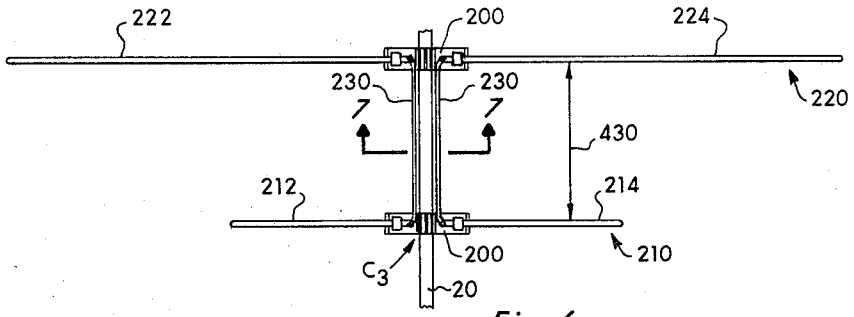
Fig. 6
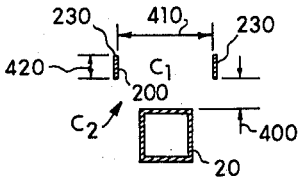
Fig. 7
Fig. 5
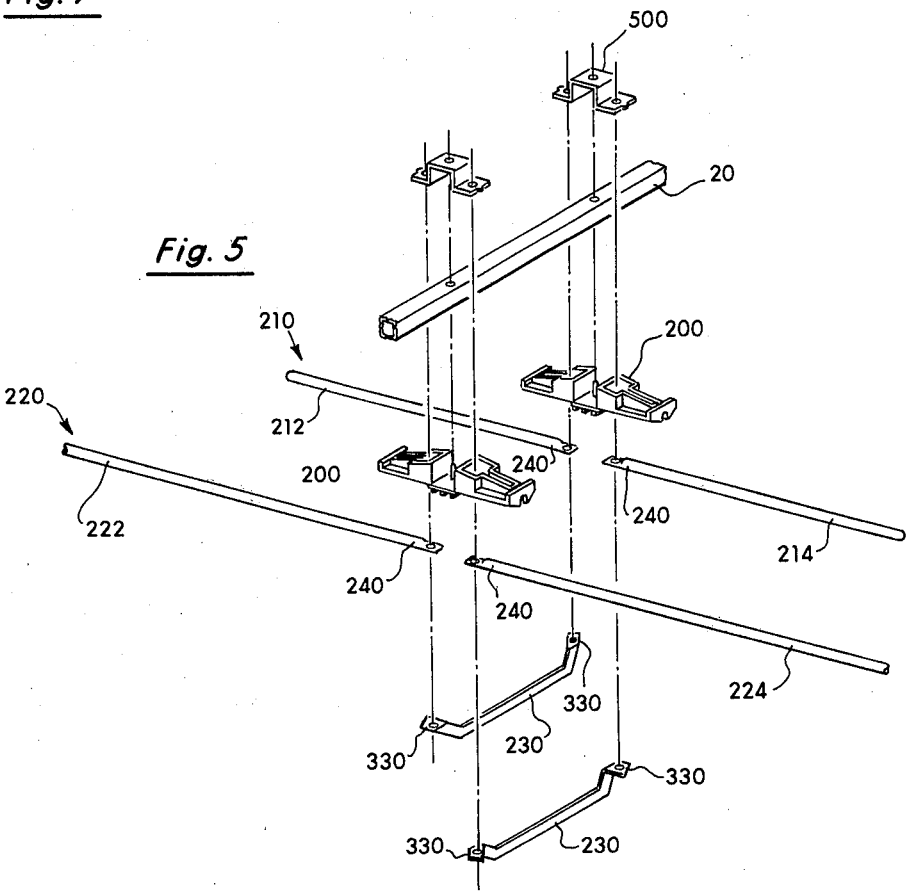

ANTENNA DIRECTOR AND METHOD THEREFOR

TECHNICAL FIELD

The present invention relates to antenna directors and methods therefor and, more particularly, to antenna directors and methods in the VHF band.

BACKGROUND ART

The provision of directors for antennas, especially VHF band antennas, have been well known for a number of years. A director has been generally defined as "a parasitic element located forward of the driven element of an antenna, intended to increase the directive gain of the antenna in the forward direction." IEEE Standard Dictionary of Electrical & Electronics Terms (1977). Typically, the directive gain of an antenna is dependent principally upon the size of the antenna, expressed in wavelengths. The larger the antenna, the greater is likely to be its gain.

In U.S. Pat. No. 2,700,105 issued to J. R. Winegard, the director element utilized inductance between its half sections to operate as a director in both the low and high VHF bands. This type of dual band director commonly appears on VHF antennas and, as set forth, in this patent, the director used a degree of inductive reactance at the high frequency end of the low VHF band to provide substantial directive gain even though the length of the elements would otherwise be too short at the high frequency end of that band to provide directional capabilities. This director utilized an inductive coupling unit interconnecting the half-sections of an element. Hence, the inboard ends of each half section were interconnected with the coupling element comprised as a folded, closed line in the low VHF band, while isolating the two half-sections in the high VHF band.

DISCLOSURE OF INVENTION

Although most dual band directors for VHF antennas improve the gain in the high end of the low VHF band, the problem with all VHF antennas regardless of the type of director elements being used is the need for more gain in the high VHF band (i.e., 174 MHz–216 MHz), especially the farther the antenna is located from the transmission source. The conventional and costly solution to this problem has been to increase the physical size of the antenna.

The director of the present invention provides a solution to the problem without substantially increasing the size of the antenna by utilizing a director that provides tuning between the inboard ends of the director elements. Furthermore, the director of the present invention utilizes two separate elements with capacitance disposed between the four inboard ends of the two elements to provide a single unitary directing effect which substantially increases the gain of the antenna in the high VHF band region. Each half section of the first element substantially half-wavelength resonates, in phase, (both half sections together) in the high VHF band whereas the second element substantially half-wavelength resonates in the high VHF band. The net result is three, in phase, and additive resonating current modes so that the combined polar pattern of the two elements, acting as a single director, does not have any minor lobes. In the low VHF band, only the first element of the director substantially resonates at a half-wavelength in the high end of the low VHF band to improve the gain in that region.

In comparison to the conventional prior art directors, as exemplified in U.S. Pat. No. 2,700,105, the director of the present invention substantially increases directive gain of the antenna without a substantial increase in the size of the antenna and furthermore results in an antenna having a lower manufacturing cost with less extending elements as compared to antennas using such conventional prior art approaches.

BRIEF DESCRIPTION OF THE DRAWING

The details of the present invention are described in the accompanying drawing:

FIG. 5 is an exploded view of the various components of the director of the present invention;

FIG. 6 is a top view of the director of the present invention mounted to the boom of an antenna;

FIG. 7 is a cross-sectional view taken through the boom of the antenna illustrating the capacitance between the phasing lines and the boom;

BEST MODE FOR CARRYING OUT THE INVENTION

1. Application of the Present Invention

Figure 1:
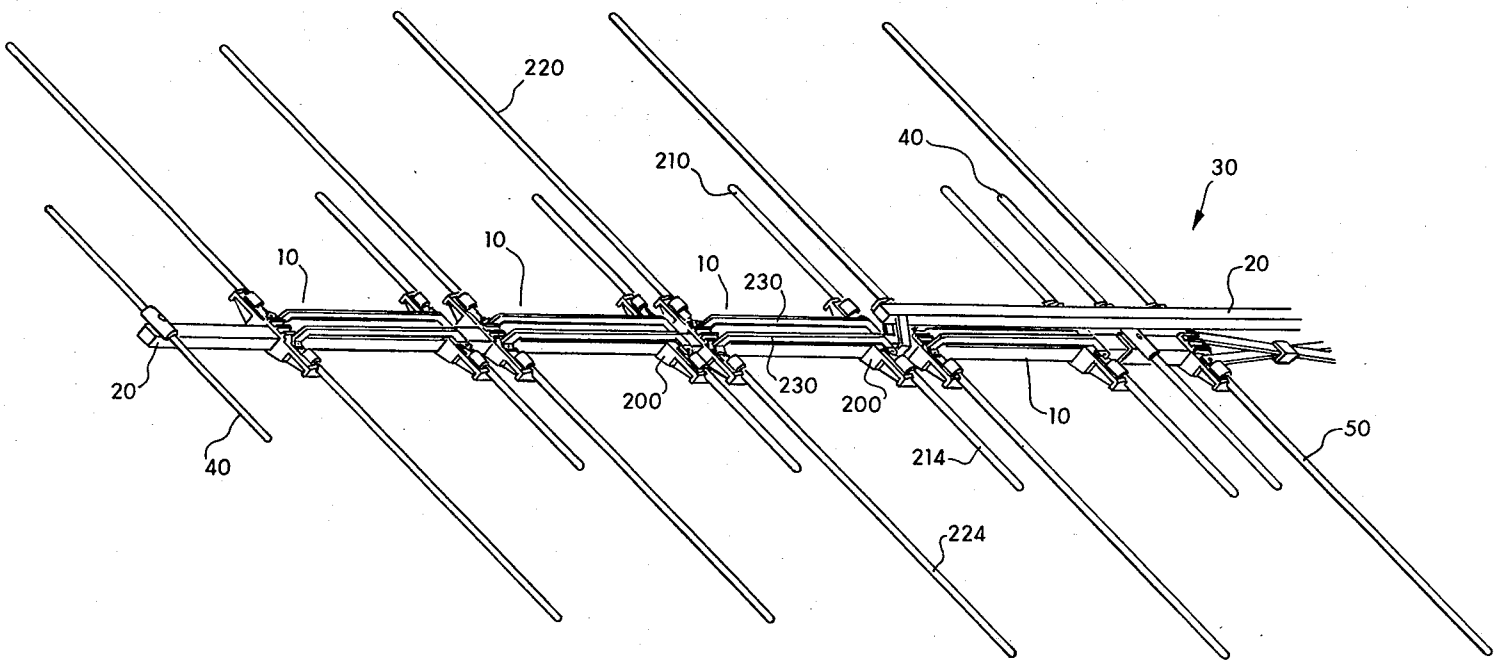
FIG. 1 sets forth an illustration of an antenna utilizing directors of the present invention.

In FIG. 1, four directors 10 of the present invention are shown mounted to the boom 20 of the VHF television antenna 30 (which is shown only in pertinent part). The antenna 30 also has conventional half-wavelength high band directors 40 and a plurality of driven elements 50 (only one of which is shown in FIG. 1) and a low band reflector (not shown) rearwardly oriented behind the driven elements 50. The directors 10 of the present invention are provided to increase the reception of electromagnetic waves onto the driven elements 50. The purpose of each director 10 of the present invention is to provide a direction of maximum radiation onto the driven elements 50.

2. Physical Construction of Present Invention

Figure 2:
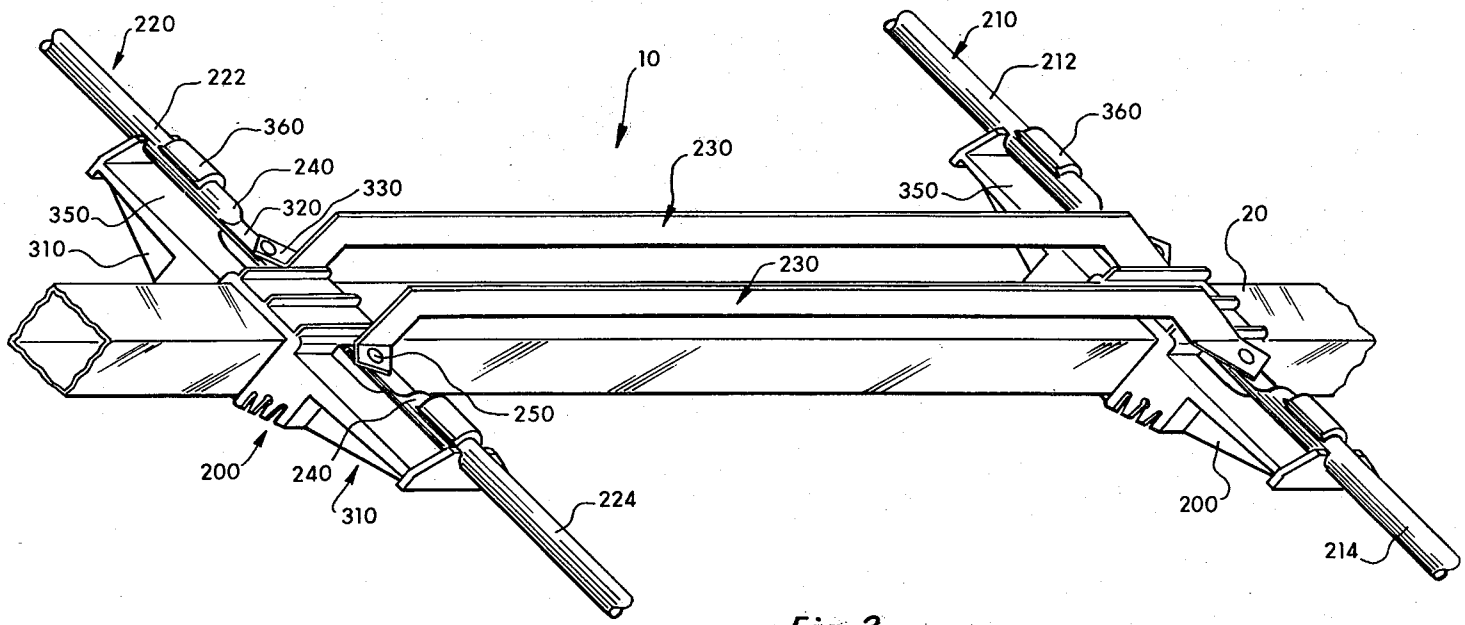
FIG. 2 is a partial perspective view of the director of the present invention mounted to the boom of an antenna.

In FIG. 2, the details of a director 10 of the present invention are shown to include two plastic insulators 200 engaging the boom 20 for supporting a pair of elements 210 and 220 in the same plane. Each element comprises two half sections. Element 210 comprises element half sections 212 and 214 and element 220 comprises two half sections 222 and 224. Mounted between the two elements 210 and 220 are a pair of opposing phasing lines 230 which are parallel to the boom 20 and which engage the in-board ends 240 of each element half section on the same side of the boom 20, as shown in FIG. 2. A rivet 250 is utilized to interconnect the phasing lines 230 through the in-board ends 240 of the element half sections to the plastic insulator 200.

Figure 4:
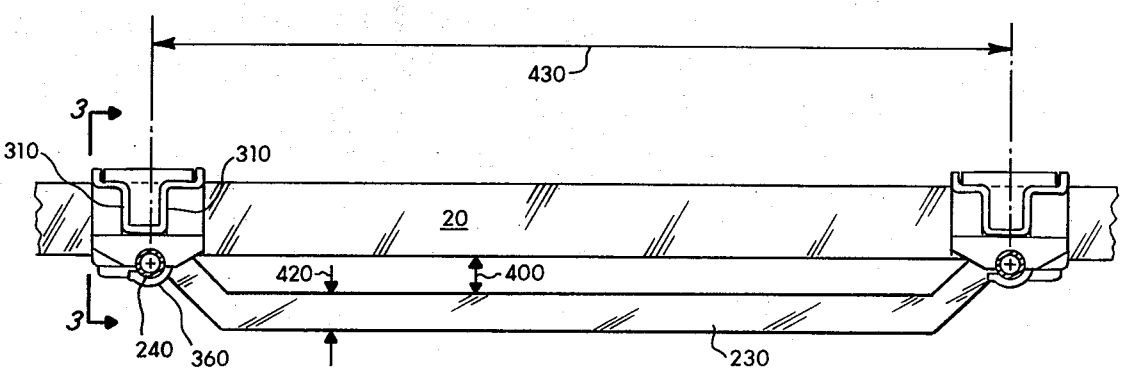
FIG. 4 is a side planar view of the phasing lines of the director of the present invention.
Figure 3:
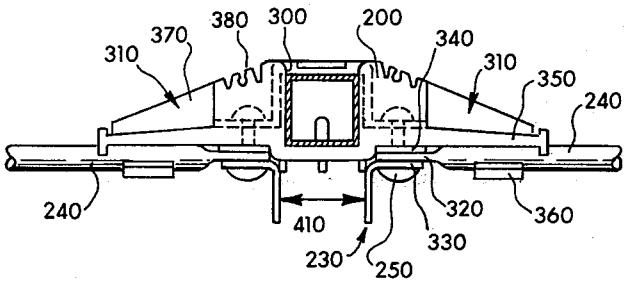
FIG. 3 is a cross-sectional front view of the in-board end of an element being mounted to and insulated from the boom of the antenna.
Figure 9:
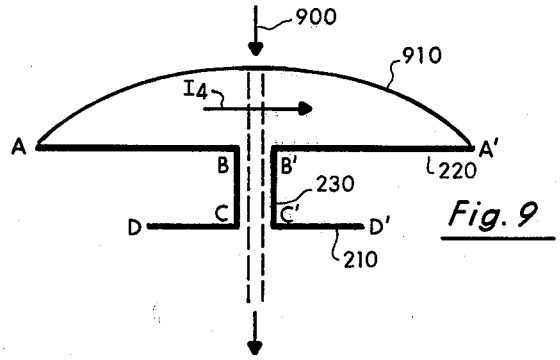
FIG. 9 is an illustration showing the current resonance of the director of the present invention in the high region of the low VHF band.

As can be seen in FIGS. 3 and 4, the plastic insulator 200 engages the periphery 300 of the boom and is firmly attached thereto in a manner which will be subsequently explained. The plastic insulator 200 has two opposing and symmetrical outwardly extending support portions 310 which provide substantial support for the flattened region 320 of in-board ends 240 of each element half section. Rivet 250 binds the flat angled portion 330 of the phasing line 230 to the flat region 320 of the in-board end 240 of the element half section and to the plastic insulator at region 340. A physical and electrical contact exists between the in-board end 240 of the element half section and the phasing line 230. This same connection exists between the phasing lines 230 and each in-board end of each element half section. Although the phasing line 230 is shown in the drawing to be mounted on the in-board end 240, it is to be understood that the phasing line could be mounted under the in-board end 240.

The plastic insulator 200 provides a flat surface 350 to support one side of the in-board end 240 and a partial circumferential engaging lock 360 on the opposing side of the in-board end 240. Hence, as shown in FIG. 3, each element half section is firmly held in place on the insulator 200 and is physically and electrically connected to one of the phasing lines 230. There is no physical electrical interconnection between the phasing lines 230 or the in-board ends 240 with the boom 20. The plastic insulator 200 also has a triangular rib support 370 to provide structural rigidity to the insulator 200.

In summary, the plastic insulator 200 shown in FIG. 3 functions to hold the respective half sections of elements 210 and 220 in a predetermined orientation with respect to the boom 20 and to support the interconnecting parallel and opposing phasing lines 230. It is to be understood that any of a number of different types of plastic, insulators, in shape and configuration, could be utilized to serve the same function.

Typically, and as shown in FIGS. 3 and 4, in the preferred embodiment of the present invention, and as designated by arrow 400, a distance of about half an inch separates the phasing line 230 from the boom 20 when viewed in a side view relationship. The boom 20 is typically one inch (2.5 cm) wide and hence, as indicated by arrows 410, a distance of approximately one inch (2.5 cm) separates the opposing phasing lines 230. The phasing lines 230 are parallel to the longitudinal length of the boom 20. The width of the phasing line 230 as indicated by arrows 420 is approximately one-half inch (1–2 cm). As indicated by arrows 430, the overall length of each phasing line 230 is approximately eleven and one-half inches (29–30 cm).

In FIG. 5, the interconnection of the various components of a director 10 of the present invention is set forth. Only five basic, and different, components are utilized due to the symmetrical nature of the invention. Each phasing line 230 is identical, the element half sections 222 and 224 of element 220 are identical, the element half sections 212 and 214 of element 210 are identical, and each plastic insulators 200 with its insulated mounting bracket 500 are identical.

In FIG. 6, the relationship between the elements 210 and 220 and the phasing lines 230 is set forth. In the preferred embodiment, each element half section 222 and 224 of element 220 has a physical length about 29 inches (73–74 cm) and the physical length of the element half sections 212 and 214 of element 210 is about 13¾ inches (35 cm). As set forth in FIG. 3, the spacing between the four ends of the element half sections when mounted to the insulator 200 on the boom 20 is approximately 1 and ½ inches (4 cm). Hence, the entire physical length of element 220 from outboard end to outboard end is approximately 59½ inches (151–152 cm). The actual physical length of element 210 from outboard end to outboard end is approximately 29 inches (73–74 cm). As previously mentioned, the length of each phasing line 230 is approximately 11½ inches (29–30 cm) which is approximately the distance between elements 210 and 220.

It is to be expressly understood that the director 10 shown in FIG. 6 represents the preferred embodiment and that variations can be made in physical lengths of elements 210, 220, and 230 as will be subsequently discussed based upon frequency and design considerations.

As set forth in FIGS. 3 and 6, the element half sections of each element 210 and 220 are separated from each other at the in-board end 240 by a distance slightly greater than the first predetermined distance 410. As shown in FIG. 7, the predetermined distance 410 separates the phasing lines 230 from each other. As also shown in FIG. 7, the parallel opposing phasing lines 230 are each located above the boom 20 by a second predetermined distance 400. Hence, FIG. 7 illustrates the width 420 of each of the phasing lines 230.

Capacitance exists in the director 10 of the present invention as shown in FIGS. 6 and 7. For clarification purposes, three types of capacitance are believed to be present and are designated capacitances C1, C2, and C3. Capacitance C1 relates to the capacitance existing primarily between the phasing lines 230, capacitance C2 relates to primarily the capacitance between the phasing lines 230 and the boom 20, and capacitance C3 relates primarily to the capacitance existing from the boom 20 through the insulator 200 and the in-board ends 240 of the element half section. It is believed that capacitance C1 provides the greatest magnitude of capacitance, capacitance C2 the next greatest in value, and capacitance C3 the least capacitance.

Finally, it is to be expressly understood that the elements and the phasing lines could be mounted below the boom, the choice being one of preference. Although a preferred embodiment has been shown, the teachings of the present invention, as will be more fully discussed, transcend the precise physical construction of this preferred embodiment.

3. Directing Capabilities of the Present Invention

Figure 8:
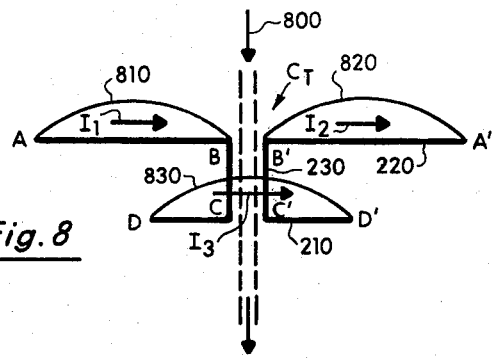
FIG. 8 is a diagram illustrating the in phase current resonances of the director elements of the present invention in the high VHF band.

In FIGS. 8 through 11 are set forth what is believed to be the method of operation of the director 10 of the present invention. In FIG. 8, is set forth what is believed to be the current resonance characteristics of director 10 in the high region (174–216 megahertz) of the VHF band.

When wave 800 in the high VHF band approaches the first element AA', the wave 800 encounters an open stub from BCD and B'C'D' having a length of 24¾ inches (about 63 cm). This length is substantially the length of a half-wavelength and the open stub reflects a high impedance or substantially open circuit across points BB' so that the currents $I_1$ and $I_2$ in wave 800 resonate on half sections AB and A'B', which are each substantially half-wavelength in length. These are shown in FIG. 8 by curves 810 and 820 for currents $I_1$ and $I_2$, respectively.

When wave 800 in the high VHF band approaches the second element DD', the wave 800 encounters an open stub from CBA and C'B'A' having a length of 40 inches (about 102 cm). This length is substantially the length of a three-quarters wavelength and the open stub reflects as a low impedance or substantially a short circuit across points CC' so that the current $I_3$ in wave 800 resonates on element DD' (210) as if element DD' were solid and of one piece construction as shown by the half wave resonance curve 830. The distance for DD' being 29 inches (about 74 cm) which is the length of each half section AB and A'B' in element AA (220).

The result of the director 10 in the high VHF band is to produce three elements resonating at half-wavelengths to produce three, in phase and additive, current modes $I_1$, $I_2$, and $I_3$.

The director 10 set forth in FIG. 8 could be designed specifically for different desired frequencies, not necessarily being limited to the high band of the VHF spectrum as set forth in the drawing. As will be discussed further, the configuration set forth in FIG. 8 effectuates a significant increase in gain for the high VHF band.

In the high end of the low VHF band, the wave 900 approaches the first element AA' (220) and encounters open stub BCD and B'C'D' again with a length of 24¾ inches (about 63 cm). This length is substantially the length of a one-quarter wavelength at approximately 102 MHz or just above channel six and the open stub reflects back a low impedance or substantially a short circuit across points BB'. The current $I_4$ in wave 900 substantially half-wavelength resonates as shown by curve 910. The element AA' appears as a solid piece in this resonating mode.

When wave 900 approaches the second element DD' (210) it encounters open stub CBA and C'B'A' of 40 inches in length. This length is substantially the length of a one-quarter wavelength at channel four which reflects a low impedance or substantial short across points CC'. However, the resultant length of element DD' is too short, at 29 inches, to resonate in the low VHF band and, hence, is inactive.

Figure 10:
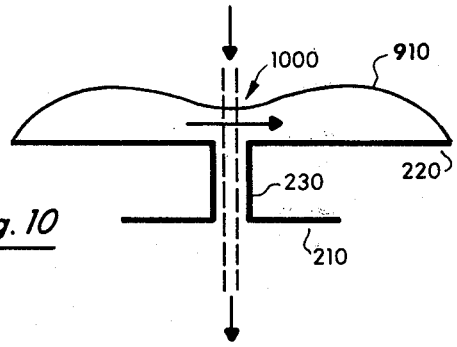
FIG. 10 is a diagram showing the resonance deteriorating in the low end of the low VHF band for the director of the present invention.

However, as shown in FIG. 10, as the frequency approaches the low end of the low VHF band the current curve 910 starts dipping in towards the element in region 1000 and resonance will cut off. Hence, at the extreme low end of the low VHF band, the elements 210 and 220 appear as an open circuit and are basically invisible in the overall reception of the antenna 30. The directors 10 of the present invention, therefore, provide significant gain in the high VHF band while reinforcing the high portion of the low VHF band.

Figure 11:
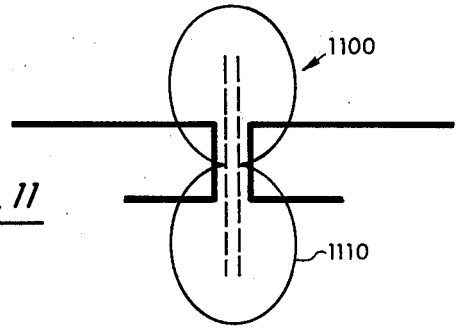
FIG. 11 is an illustration of the polar diagram of the director of the present invention.

The polar pattern of the director 10 of the present invention shown in FIG. 6 is depicted in FIG. 11 as curves 1100 and 1110.

The operation of the director 10 of the present invention can be summarized as follows. When the wave encounters an element having its half sections connected across a particular length open stub and which has a certain amount of capacitance $C_T$, (i.e., C1+C2+C3) the element can either see a low impedance (short) or a high impedance (open) across its physically separated half sections. If the length of the open stub is an odd wavelength such as one-quarter or three-quarters wavelength of the incoming wave, the reflected impedance from the stub to the separation between the half sections of the element is low (a substantial short) and the element and its half sections, if a half-wavelength, resonate as a single piece. If the length of the open stub is an even wavelength such as one half wavelength of the incoming wave, the reflected impedance from the stub to the separation between the half sections of the element is high (a substantial open) and each half section, if a half-wavelength of the incoming wave, will separately resonate. In the preferred embodiment, the physical lengths, the physical spacings and the inter-relationship between the two pairs of half sections from elements 210 and 220 and the interconnecting phasing lines 230 provide sufficient tuning between the four in-board ends of the half sections of elements 210 and 220 to effectuate the above discussed reflected impedances.

Although the above is believed to be the operation of the present invention based upon the experience of the inventors, it is to be noted that antenna theory, in general, often belies precise formulation and is rather primarily an art based upon practical insight and experimentation. Whatever, the precise theory, the results of the present are clear as set forth in the following.

PERFORMANCE OF THE PRESENT INVENTION

Figure 12:
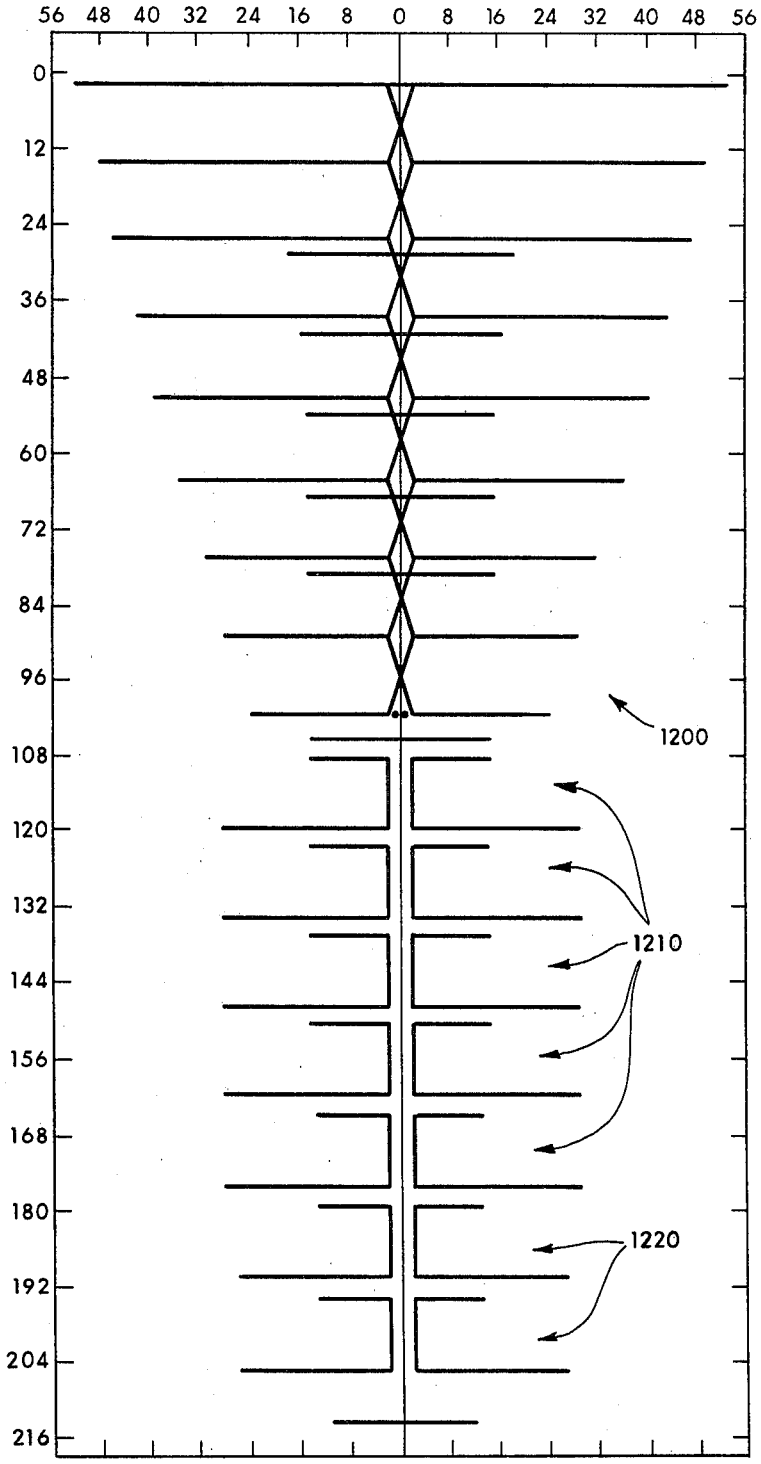
FIG. 12 is a dimensional graph showing a number of the directors of the present invention mounted to a VHF antenna.

In FIG. 12 is diagramatically shown an antenna 1200 superimposed upon a dimensional scale. Antenna 1200 incorporates seven directors 10 of the present invention (designated 1210 and 1220). Antenna 1200 also has conventional directors, driven elements, and a reflector.

The directors 10 of the present invention shown in FIG. 12 on antenna 1200 have some of the elements 210 and 220 with different lengths. For example, the first two directors 1210 have elements 210 and 220 which are shorter than the next five directors commonly designated 1210. Each director is separated from the other director by a distance of approximately three inches (7.6 cm) on the boom. The aforementioned separation difference is optimized for maximum coupling between the directors.

Figure 13:
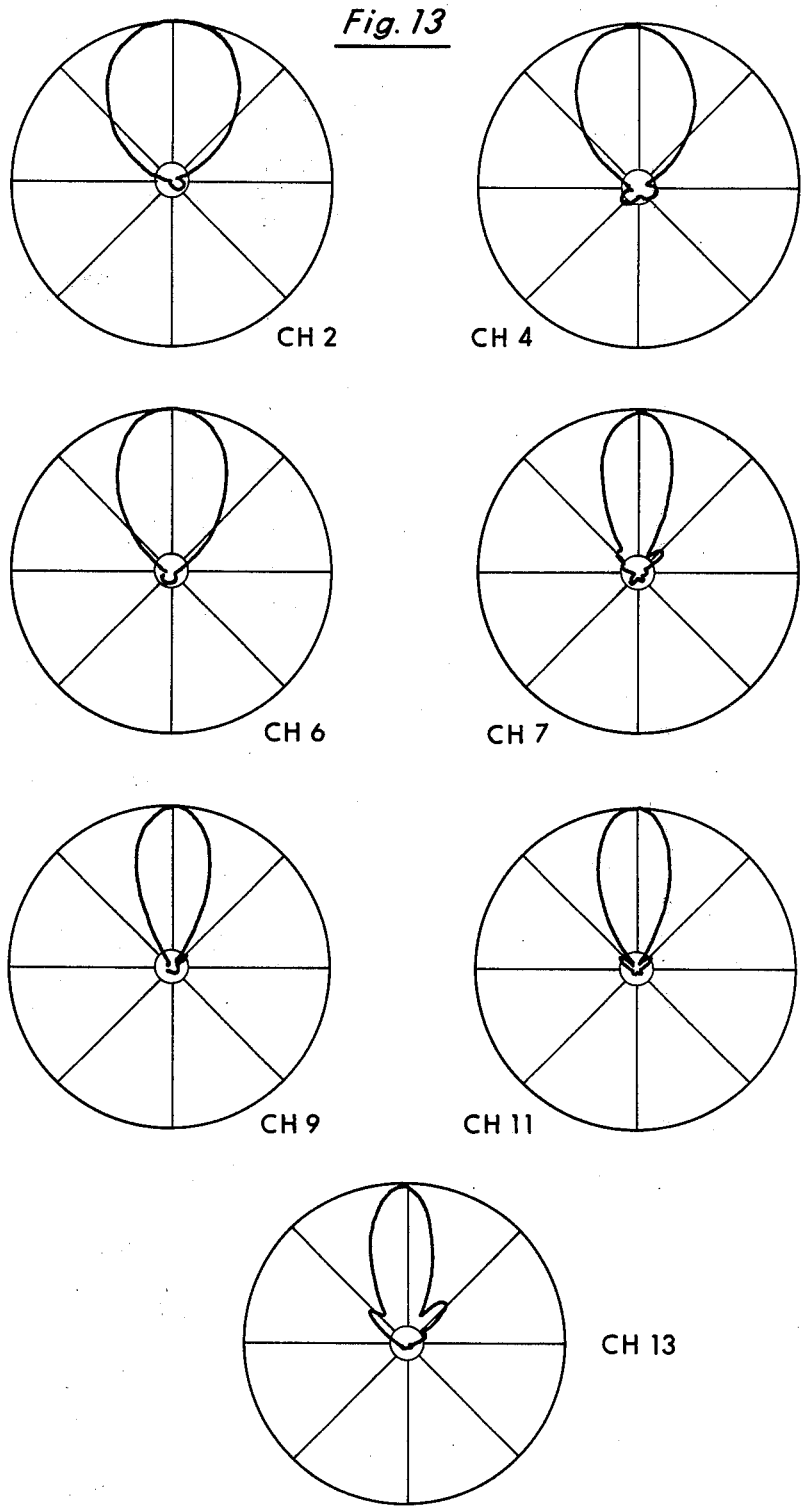
FIG. 13 illustrates the polar charts for the antenna shown in FIG. 12.

The polar patterns for antenna 1200 are set forth in FIG. 13. The front-to-back ratios are all over 20 db and the 0.707 beam widths are set forth in the following table:

| Channel | .707 Beam Width |
|---|---|
| 2 | 70° |
| 4 | 60° |
| 6 | 55° |
| 7 | 33° |
| 9 | 35° |
| 11 | 35° |
| 13 | 28° |

The gain of the antenna 1200 shown in FIG. 12 when compared to a reference dipole is as follows:

| Channel | Antenna 1200 | Antenna Model 5200 | Antenna Model CH4052 |
|---|---|---|---|
| 2 | 6.3 | 6.3 | 4.3 |

-continued

| Channel | Antenna 1200 | Antenna Model 5200 | Antenna Model CH4052 |
|---|---|---|---|
| 4 | 7.3 | 7.3 | 5.5 |
| 6 | 7.0 | 8.0 | 5.9 |
| 7 | 13.2 | 11.8 | 8.3 |
| 9 | 12.8 | 11.6 | 9.2 |
| 11 | 14.1 | 12.2 | 8.4 |
| 13 | 11.5 | 11.8 | 8.7 |

Antenna Model CH5200 is the largest of the CHROMSTAR series of antenna available from Winegard Company, 3000 Kirkwood Street, Burlington, Iowa and comprises a total of 39 elements. The Model CH5200 is a VHF antenna having a boom length of 200 inches (about 300 cm). It utilizes the Electrolens director system as first set forth in U.S. Pat. No. 2,700,105. In comparison to the antenna 1200 using the directors 10 of the present invention, the gain through channels 2 through 6 are substantially the same. This represents the low VHF band. However, in channels 7 through 11 there is a significant increase in gain in comparison to the Model CH5200. The conventionally available Model CH4052, also in the CHROMSTAR line, is listed above for reference purposes. The Model CH4052 has a boom length of 75 inches (about 190 cm) with 17 elements.

It is apparent in the above table, that a significant increase in gain in the high VHF band region has been achieved through use of the directors 10 of the present invention without a significant increase in the size of the antenna. It is well known in VHF antenna design that doubling the size will result in a 2 to 3 db gain. This can be seen by comparing the Model CH4052 with the Model CH5200. However, a 1 to 2 db gain in the high VHF band has been achieved through use of the directors 10 of the present invention with only a slight increase in the size of the antenna.

Furthermore, antenna 1200 utilizes thirty-one elements whereas Model 5200 utilizes thirty-nine elements—an approximate twenty percent in material savings; yet, providing an approximate thirteen percent increase in gain for channels 7 through 11.

It is to be expressly understood, that the gain for the antenna 1200 could be increased even further if each of the seven directors 1240 and 1250 had their respective elements 210 and 220 designed, so that as the farther away from the driven element 1220 the director is placed, the shorter elements 210 and 220 become. This tapering in element length from the longest being located nearest the front driven element to shortest being located at the front of the antenna is generally known to increase the overall gain of the antenna for other types of directors. In this particular case, antenna 1200 was designed to minimize production and inventory cost and, hence, the first five directors are identical in element lengths and do not taper as discussed above. Hence, optimum gain of an individual antenna has been slightly compromised in order to minimize the inventory of parts and the related costs associated therewith. Even so, significant gain is achieved in the high band of the VHF region over prior art and conventional approaches.

While the method and directors of the present invention has been specifically set forth in the above for a VHF design, it is to be expressly understood that modifications and variations to both the method and the director can be made for the same or different frequencies which would still fall within the scope and coverage of the appended claims.

We claim:

1. A VHF antenna (30) having a plurality of improved directors (10) mounted on the front of the boom (20) of said antenna, each of said improved directors (10) comprising:

a first insulator (200) mounted to said boom (20), a first element (220) connected to said first insulator (200), said first element (220) having two half sections (222, 224) with the inboard ends (240) of each half section being connected to said first insulator (200), the aforesaid ends (240) being separated from each other on said first insulator (200) by a first predetermined distance (410), each of said half sections (222, 224) of said first element (220) having an electrical length of substantially one-half wavelength at a frequency in the high end of the VHF band, a second insulator (200) mounted to said boom (20), a second element (210) connected to said second insulator (200) and positioned in the same plane as said first element (220), said second element (210) having an electrical length of substantially one-half wavelength at a frequency in the high end of the VHF band, said second element (210) having two half sections (212, 214) with the inboard ends (240) of each half section being connected to said second insulator (200), the aforesaid ends (240) being separated from each other on said second insulator (200) by said first predetermined distance (410), said second element (210) being spaced (430) from said first element (220), a pair of opposing phasing lines (230) parallel to the longitudinal length of said boom (200) and located near said boom a second predetermined distance (400), said parallel phasing lines (230) being separated from each other by said first predetermined distance (410), each phasing line (230) electrically interconnecting said inboard ends (240) of said first and second element half sections located on the same side of said boom (20), each of said phasing lines (230) being elongated flat surfaces (700) oriented with the flat surface (700) of each phasing line (230) directly opposing the other, said first and second predetermined distances (400, 410) and said spacing (430) between said first and second elements (210 and 220) effectuating a predetermined degree of capacitance ($C_T$) between said phasing lines (230) and between said phasing lines (230) and said boom (20) to provide sufficient tuning to effectuate half-wavelength resonating currents ($I_1$, $I_2$ and $I_3$) in the first half section (222) of said first element (220), the second half section (224) of said first element (220), and in said second element (210) that are substantially in phase and additive.

2. A VHF antenna (30) having at least one improved director (10) mounted to the boom (20) of said antenna (30) said improved director comprising:

a first insulator (200) mounted to said boom (20), a first element (220) connected to said first insulator (200), said first element (220) having two half sections (222, 224) with the inboard end (240) of each half section being connected to said first insulator (200), the aforesaid ends (240) being separated from each other on said first insulator (200), each of said half sections (222, 224) of said first element (220)

having an electrical length of substantially one-half wavelength at a frequency in the high end of the VHF band, a second insulator (200) mounted to said boom (20), a second element (210) connected to said second insulator (200), said second element (210) having an electrical length of substantially one-half wavelength at a frequency in the high end of the VHF band, said second element (210) having two half sections (212, 214) with the inboard end (240) of each half section being connected to said second insulator (200), the aforesaid ends (240) being separated from each other on said second insulator (200), a pair of opposing phasing lines (230) parallel to the longitudinal length of said boom (20) and separated from each other and located near said boom (20), each phasing line (230) electrically interconnecting said inboard ends (240) of said first and second element half sections located on the same side of said boom (20), said phasing lines (230) providing sufficient tuning between said first and second elements (210 and 220) to effectuate so resonating currents ($I_1$, $I_2$ and $I_3$) in the first half section (222) of said first element (220), the second half section (224) of said first element (220), and in said second element (210) that are substantially in phase and additive.

3. The VHF antenna of claim 2 wherein the distance (430) between each of said elements (210, 220) is substantially one-quarter wavelength at a frequency in said high end of said VHF band.

4. The VHF antenna of claim 2 wherein said second element (210) is in the same plane as said first element (220).

5. The VHF antenna of claim 2 wherein each of said phasing lines (230) are elongated flat surfaces (700) oriented with the flat surface (700) of each phasing line (230) directly opposing the other.

6. An antenna (30) having a plurality of improved directors (10) mounted to the boom (20) of said antenna (30), each of said improved directors (10) comprising:

a first element (220), said first element (220) having two symmetrical half sections (222, 224) with the inboard ends (240) of each aforesaid half section mounted (200) to and insulated from each other and from said boom (20), each of said half sections (222, 224) of said first element having an electrical length of substantially one-half wavelength at a desired frequency, a second element (210), said second element (210) having two symmetrical half sections (212, 214) with the inboard ends (240) of each aforesaid half section mounted to and insulated (200) from each other and from said boom (20), said second element (210) having an electrical length of substantially one-half wavelength at said desired frequency, means (230) on opposing sides of said boom (20) for interconnecting the inboard ends (240) of said first and second element symmetrical half sections (212 and 222, 214 and 224) located on opposing sides of the boom (20) to provide sufficient tuning between the opposing interconnected symmetrical first and second element half sections to effectuate a high impedance between the half sections (222, 224) of said first element (220) and produce half wavelength resonating currents ($I_1$ and $I_2$) in each half section and to further effectuate a low impedance between the half sections (212, 214) of said second element (210) and produce a half wavelength resonating current ($I_3$), said currents ($I_1$, $I_2$, and $I_3$) being substantially in phase and additive.

7. An improved director (10) mounted to the boom (20) of a VHF antenna (30), said improved director (10) being capable of increasing the gain of said antenna (30), said improved director (10) comprising:

a first element (220), said first element (220) having two symmetrical half sections (222, 224) with the inboard ends (240) of each aforesaid half section mounted to (200) and insulated from each other and from said boom (20), said first element (220) being of sufficient length to half-wavelength resonate in the high end of the low VHF band, each half section (222, 224) being of sufficient length to half wavelength resonate in the high VHF band, a second element (210), said second element (210) having two symmetrical half sections (212, 214) with the inboard ends (240) of each aforesaid half section mounted to (200) and insulated from each other and from said boom (20), said second element (210) being of sufficient length to resonate only in the high VHF band, and means (230) on opposing sides of said boom (20) for interconnecting the inboard ends (240) of said first and second element symmetrical half sections (212 and 222, 214 and 224) located on opposing sides of the boom (20) and for providing sufficient tuning between the opposing interconnected symmetrical first and second element half sections to effectuate, in the high VHF band, (a) a high impedance between the half sections 222, 224) of said first element (220) and produce half wavelength resonating currents ($I_1$ and $I_2$) in each aforesaid half section and (b) a low impedance between the half sections (212, 214) of said second element (210) and produce a half wavelength resonating current ($I_3$) across said second element (210) wherein all of said currents ($I_1$, $I_2$ and $I_3$) are in phase and substantially additive, said tuning further effectuating, in the low VHF band a low impedance between the half sections (222, 224) of said first element (220) and producing a half wavelength resonating current ($I_4$) across said first element (220).

8. The improved director of claim 7 wherein said first element (220) is separated from said second element (210) approximately one-quarter wavelength at a frequency in said high end of said VHF band.

9. An improved director (10) mounted to the boom (20) of an antenna (30), said improved director (10) being capable of increasing the gain of said antenna (30), said improved director (10) comprising:

a first element (220), said first element (220) having two symmetrical half sections (222, 224) with the inboard ends (240) of each aforesaid half section mounted to (200) and insulated from each other and from said boom (20), a second element (210), said second element (210) having two symmetrical half sections (212, 214) with the inboard ends (240) of each aforesaid half section mounted to and insulated from each other and from said boom (20), and means (230) for interconnecting the inboard ends (240) of said first and second element symmetrical half sections (212 and 222, 214 and 224) and for providing sufficient tuning between the interconnected symmetrical first and second element half sections to effectuate, at a desired frequency, a high impedance between the half sections (222, 224) of said first element (220) and produce resonating currents ($I_1$ and $I_2$) in each aforesaid half section and (b) a low impedance between the half sections (212, 214) of said second element (210) and produce a resonating current ($I_3$) across said second element (210) wherein all of said currents ($I_1$, $I_2$ and $I_3$) are in phase and substantially additive.

10. The improved director (10) of claim 9 wherein said tuning further effectuates, at a second desired frequency a low impedance between the half sections (222, 224) of said first element (220) and producing a half wavelength resonating current ($I_4$) across said first element (220).

11. The improved director (10) of claim 10 wherein said desired frequency is in the high VHF band and said second desired frequency is in the high end of the low VHF band.

12. A method for directing electromagnetic signals (800) in the high VHF band on a VHF antenna (30) to improve the gain of said antenna (30), said method comprising the steps of:

resonanting a first element (220) having two half sections (222, 224) separated by insulators (200) in said high VHF band to provide a first current signal ($I_1$) in the first half section (222) and a second current signal ($I_2$) in the second half section (224), resonating a second element (210) having two half sections (212, 214) separated by insulators (200) in said high VHF band to provide a third current signal ($I_3$), providing sufficiently high impedance between the opposing inboard ends (240) of the half sections (222 and 224) across said insulator (200) of said first element (210) so that each half section (222, 224) separately resonates in phase with each other, and providing sufficiently low impedance between the opposing inboard ends (240) across said insulator (200) of the half sections (212 and 214) to that said second element (210) resonates in phase with said first element.

13. A method for directing electromagnetic signals in the high VHF band (800) and in the high end of the low VHF band (900) of a VHF antenna (30), said method comprising the steps of:

resonating a first element (220) having two physically and electrically separated half sections (222, 224) in the high VHF band (800) to provide a first current signal ($I_1$) in the first half section (222) and a second current signal ($I_2$) in the second half section (224), resonating a second element (210) having two physically and electrically separated half sections (212, 214) in the high VHF band (800) to provide a third current signal ($I_3$) across said second element (210), said first, second, and third current signals being in phase with each other, reflecting a sufficiently high impedance to the region between the opposing inboard ends (240) of the half sections (222 and 224) of the first element when the signals in the high VHF band (800) encounters a first open stub (BCD B'C'D') formed by (a) the opposing physical and electrical connection between the inboard ends (240) of the first element (220) and the inboard ends (240) of the second element (210) and (b) the second element (210), reflecting a sufficiently low impedance to the region between the opposing inboard ends (240) of the half sections (212, 214) of the second element (210) when the signals in the high VHF band (800) encounter a second open stub (CBA, C'B'A') formed by (a) the opposing physical and electrical connection between the inboard ends (240) of the first element (220) and the inboard ends of the second element (210) and (b) the first element (220), resonating said first element (220) in the high end of the low VHF band (900) to provide a fourth current signal ($I_y$) across said first element (220), and reflecting a sufficiently low impedance to the region between the opposing inboard ends (240) of the half sections (222, 224) of the first element when the signals in the high end of the low VHF band (900) encounter the first open stub (BCD, B'C'D').

* * * * *